US005970604A

United States Patent [19]

Person et al.

[11] Patent Number: 5,970,604

[45] Date of Patent: Oct. 26, 1999

[54] METHOD OF MAKING MONOLITHIC THICK FILM INDUCTOR

[75] Inventors: Herman R. Person, Columbus, Nebr.; Kyle Clark, Milford, Conn.; Scott D. Zwick, Columbus, Nebr.; Jeffrey T. Adelman, Columbus, Nebr.; Thomas L. Veik, Columbus, Nebr.

[73] Assignee: Dale Electronics, Inc., Columbus, Nebr.

[21] Appl. No.: 08/881,480

[22] Filed: Jun. 24, 1997

Related U.S. Application Data

[62] Division of application No. 08/665,788, Jun. 18, 1996.

[51] Int. Cl.[6] ..... H01F 3/02

[52] U.S. Cl. ..... 29/609; 29/602.1; 29/606; 336/200

[58] Field of Search ..... 29/602.1, 606, 29/607, 608, 609; 236/200, 232, 234; 427/282, 261, 265, 266

[56] References Cited

U.S. PATENT DOCUMENTS

| | | | |
|---|---|---|---|
| 3,833,872 | 9/1974 | Marcus et al. | 336/200 |
| 4,322,698 | 3/1982 | Takahashi et al. . | |
| 4,641,118 | 2/1987 | Hirose et al. | 336/200 |
| 4,689,594 | 8/1987 | Kawabata et al. . | |
| 4,731,297 | 3/1988 | Takaya . | |
| 5,302,932 | 4/1994 | Person | 336/200 |

FOREIGN PATENT DOCUMENTS

| | | | |
|---|---|---|---|
| 0 326 999 | 8/1989 | European Pat. Off. . | |
| 772528 | 4/1957 | United Kingdom | 336/200 |
| 993265 | 5/1965 | United Kingdom | 336/200 |

*Primary Examiner*—Lee Young
*Assistant Examiner*—Davide Caputo
*Attorney, Agent, or Firm*—Zarley, McKee, Thomte, Voorhees & Sease

[57] ABSTRACT

A monolithic thick film inductor is made by printing alternating conductive layers and dielectric layers above one another, using the same dielectric printing screen and the same conductor printing screen for printing each of the dielectric layers and the conductive layers respectively. Each of the coil printing screen and the dielectric screen are indexed to n different positions in order to print each of the n layers. The resulting inductor includes a plurality of helical coil segments stacked above one another and electrically connected to one another to create the desired number of coil turns.

7 Claims, 8 Drawing Sheets

METHOD OF MAKING MONOLITHIC THICK FILM INDUCTOR

This application is a divisional of U.S. patent application Ser. No. 08/665,788, filed Jun. 18, 1996, entitled "MONOLITHIC THICK FILM INDUCTOR AND METHOD FOR MAKING SAME", now pending.

BACKGROUND OF THE INVENTION

The present invention relates to a monolithic thick film inductor and method for making same.

Many prior art methods have been used for printing monolithic thick film inductors. Most of these methods include printing alternating layers of coils and dielectric layers (usually ferrite). Each coil is a segment and the coil segments are interconnected through the ferrite layers to create a continuous helical coil inductor.

Most prior art methods for creating these monolithic film inductors involve separate printing screens for each layer that is printed to create the inductor.

Therefore a primary object of the present invention is the provision of an improved monolithic thick film inductor and method for making same.

A further object of the present invention is the provision of a monolithic thick film inductor which can be printed with a minimum of printing screens or patterns that can be repeated several times as the various laminated layers are printed.

A further object of the present invention is the provision of a monolithic thick film inductor and method for making same which requires less equipment to mass produce the inductor.

A further object of the present invention is the provision of a monolithic thick film inductor wherein the length and width of the coil remains constant throughout the part from the bottom to the top.

A further object of the present invention is the provision of an improved monolithic thick film inductor which can be manufactured in smaller parts than has been the case in the prior art.

A further object of the present invention is the provision of a monolithic thick film inductor which is easily adaptable to automated manufacture.

A further object of the present invention is the provision of an improved monolithic thick film inductor and method for making same wherein the inductor is more economical to manufacture, durable in use, and efficient in operation.

SUMMARY OF THE INVENTION

The foregoing objects may be achieved in a laminated electrical component which includes a substrate having two or more laminated assemblies stacked vertically above one another on the substrate. Each of the laminated assemblies comprises n conductive layers and n dielectric layers stacked above one another in alternating fashion. Each of the n conductive layers comprises a conductive coil segment. The conductive coil segments are each different from one another and are formed into segments of a helix. Each of the dielectric layers overlies one of the n conductive layers and includes a connecting opening exposing a portion of the coil segment therebelow. All of the conductive coil segments within each of the n conductive layers are connected together through the conducting openings in the dielectric layers to form a helical conductive sub coil. All of the two or more laminated assemblies are of identical construction, and are connected together to form a helical coil having a lower end and an upper end and two or more helical turns extending therebetween.

The two or more laminated assemblies are positioned between a bottom termination layer and a top termination layer, each of which contain terminations for connecting the upper and lower ends respectively of the helical coil in an electrical circuit.

In the preferred embodiment n is chosen to be 2 so that there are two laminated assemblies, and two coil segments in each of the laminated assemblies. However, n may be chosen to be 3 or more, depending upon the needs of a particular application.

The method of the present invention comprises printing a first conductive layer in a first index position on a substrate with a coil printing screen. The first conductive layer comprises n coil segments arranged in side to side relationship, each of the n coil segments being different from one another and comprising a different segment of a helical coil.

Next a first dielectric layer is printed with a dielectric screen on the first conductive layer. The first dielectric layer has a plurality of connecting openings therein, each of which is registered above and exposes a portion of one of the n coil segments therebelow.

Next the coil printing screen and the dielectric printing screen are indexed from the first indexed position to a total of n indexed positions one at a time. At each of the n index positions an additional conductive layer and an additional dielectric layer are printed with the coil printing screen and the dielectric printing screen until a total of n conductive layers and n dielectric layers have been printed.

Each of the n indexed positions is chosen so that a different one of the n coil segments in each of the additional conductive layers is registered above a selected one of the n coil segments in the first conductive layer.

All of the coil segments registered above the selected one coil segment are joined to one another and to the selected coil segment through the connecting openings in each of the dielectric layers so as to form a first helical sub coil.

After forming the first helical sub coil the coil printing screen and the dielectric printing screen are shuttled back to their first index position. The steps for forming the first helical sub coil are then repeated one or more times so as to form one or more additional helical sub coils which are in electrical connection with one another and with the first helical sub coil, and which are above the first helical sub coil.

One embodiment of the method utilizes sufficiently large connecting openings in the dielectric layers to permit the various coil segments to contact one another through the connecting openings in the dielectric. Another modification of the present invention utilizes conductive via fills printed in each of the connecting openings to provide electrical connection between the coil segments above and below each layer of dielectric.

DETAILED DESCRIPTION OF THE PREFERRED EMBODIMENT

Figure 1:
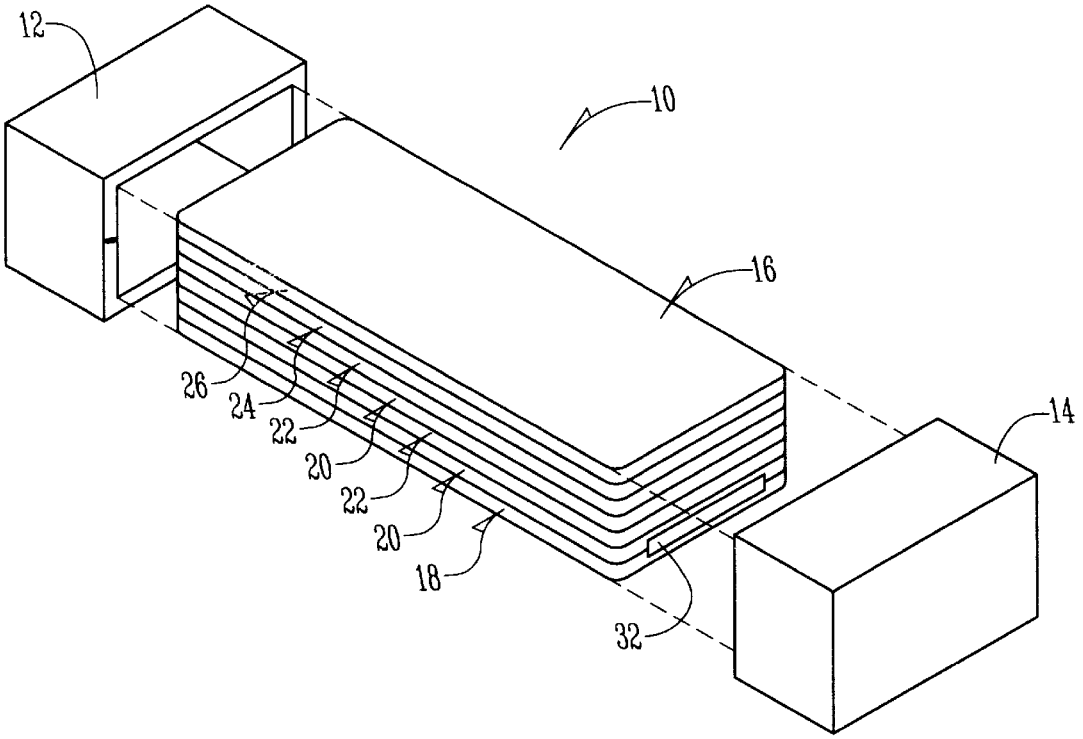
FIG. 1 is an exploded perspective view of a monolithic thick film inductor made according to the present invention.
Figure 2:
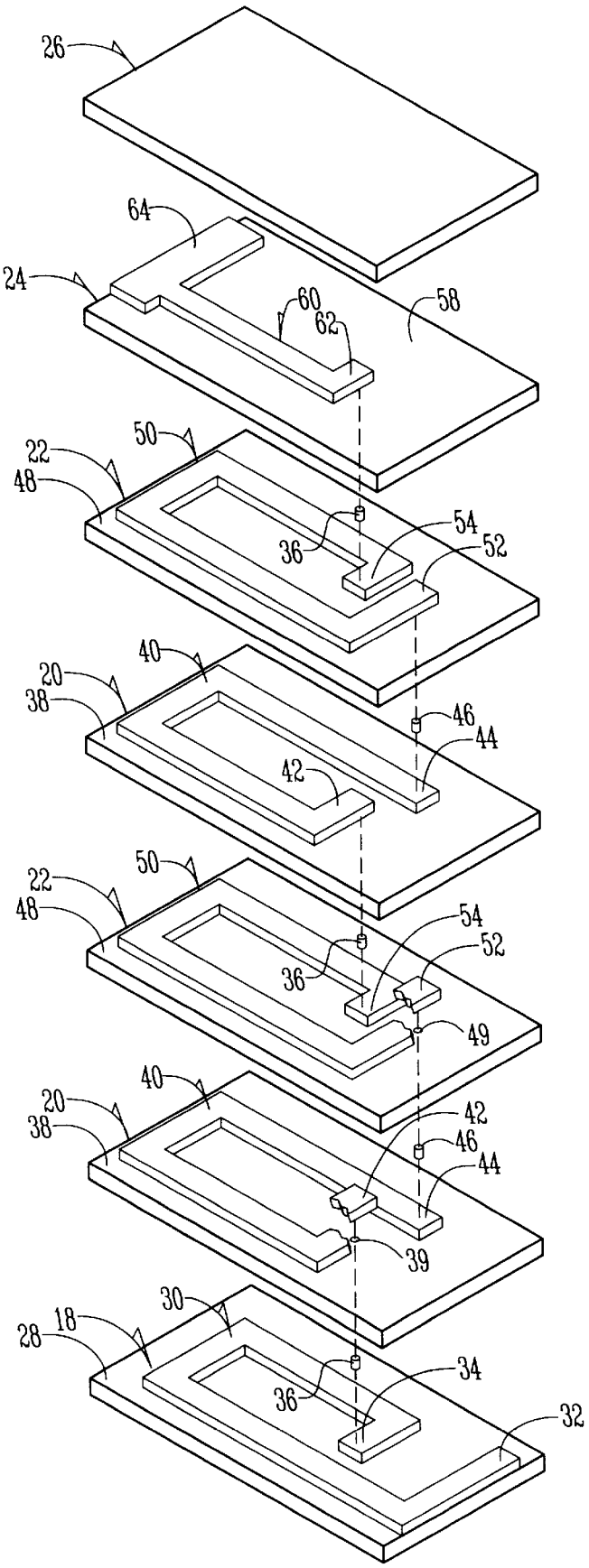
FIG. 2 is an exploded perspective view of the inductor of FIG. 1, showing each of the various laminated layers.

Referring to FIGS. 1–3, a monolithic inductor 10 having termination caps 12, 14 mounted over its opposite ends. A laminated assembly 16 includes a bottom termination layer 18. Printed over bottom termination layer 18 are a first middle layer 20 and a second middle layer 22. Middle layers 20, 22 are repeated twice in the inductor shown in FIG. 1, but the number of repetitions may be varied according to the desired inductance required for any particular inductor. Middle layers 20, 22 may be repeated an equal number of times, or one of the layers may be repeated one more time than the other middle layer.

Printed over the top of the upper most middle layer 20, 22 is a top termination layer 24 which is covered by a top cover 26 formed of dielectric material. The preferred dielectric material is ferrite, but other types of dielectric material may be used without detracting from the invention.

Bottom termination layer 18 includes a bottom ferrite layer 28 which is formed by printing numerous layers of ferrite over one another to achieve the desired thickness. Printed over the bottom ferrite layer 28 is a bottom termination conductor 30 having a termination end 32 and a second end 34. Termination 32 is exposed at one end of assembly 16 as can be seen in FIG. 1.

First middle layer 20 includes a dielectric middle ferrite layer 38 having a connecting opening or via opening 39 therein registered above the second end 34 of bottom termination conductor 30.

Printed within connecting opening 39 is a via fill 36. Printed over the top of middle ferrite layer 38 is a first coil segment 40 having a first end 42 which is registered over and in electrical contact with via fill 36, and having a second end 44. Via fill 36 provides electrical connection between the second end 34 of the bottom termination conductor 30 and the first end 42 of the first coil segment 40. So as to provide a continuous helical conductor.

Second middle layer 22 includes a second ferrite layer 48 and a second coil segment 50 printed thereover and having a first end 52 and a second end 54. A via fill 46 fills a second via opening 49 in second ferrite layer 48. The via fill 46 provides electrical connection between the second end 44 of first coil segment 40 and the first end 52 of the second coil segment 50 thereby providing a continuation of the helical coil conductor.

As can be seen in FIG. 2, first middle layer 20 and second middle layer 22 are repeated a second time so as to provide electrical connection between one another and between the coil conductors therebelow.

Top termination 24 is printed over the upper most one of middle layers 20, 22 (in this case over middle layer 22) and includes a top ferrite layer 58 which is identical to middle ferrite layer 38. Printed over top ferrite layer 58 is a top termination conductor 60 having a first end 62 in electrical contact with via fill 36 and having a termination end 64 which is exposed at the opposite end of laminated assembly 16 from the termination end 32 of bottom termination layer 18. Thus when caps 12, 14 are placed over assembly 16, cap 14 comes in contact with bottom termination end 32 and cap 12 comes in contact with top termination 64. Thus the inductor 10 provides a continuous helical coil conductor which commences with bottom termination end 32 and continues in a helical path upwardly where it terminates in upper termination 64.

The ferrite layers 38 and 58 are identical to one another and the ferrite layers 48 are all identical to one another.

If the upper most middle layer is middle layer 20 then top termination conductor 60 has a slightly different configuration (not shown), and the ferrite layer 58 has a configuration the same as ferrite layer 48. Each of the middle coil segments 40, 50, form approximately a complete 360° turn of a helical coil.

Figure 3A:
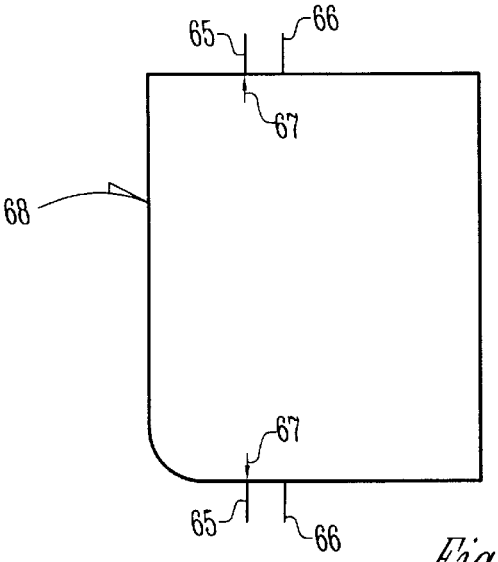
FIG. 3A is a plan view of a bottom cap screen used for printing the inductor of FIGS. 1 and 2.

FIGS. 3A–3J show the various printing screens used for printing the layers to form inductor 10. A bottom cap screen 68 (FIG. 3A) is used to print bottom ferrite layers 28. The position of bottom cap screen 68 is shown relative to index marks 65, 66 by an index arrow 67. In FIG. 3A the bottom printing screen 68 is shown in its first index position with arrow 67 aligned with index mark 65.

Figure 3B:
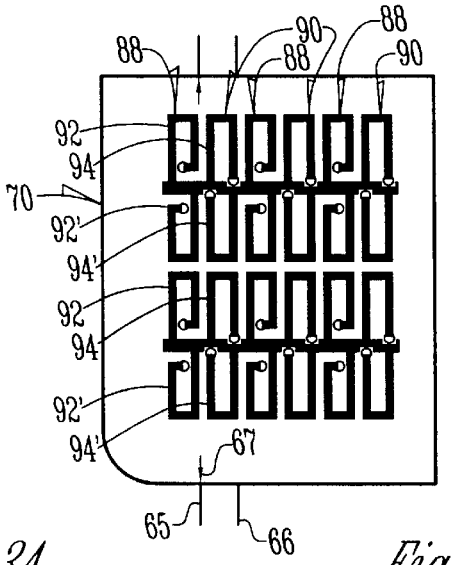
FIG. 3B is a plan view of a bottom termination screen used for printing the bottom layer of the inductor of FIG. 1.
Figure 3F:
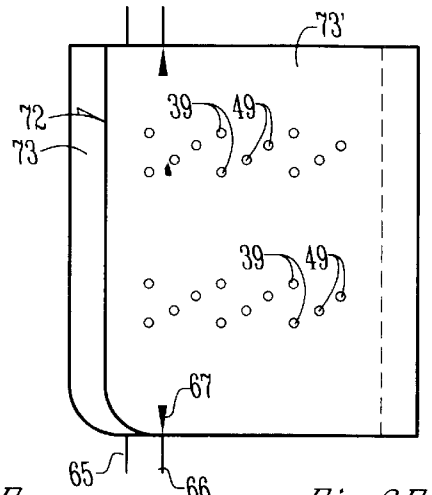
FIG. 3F is a plan view showing the second indexed position of the dielectric screen of FIG. 3C.
Figure 3E:
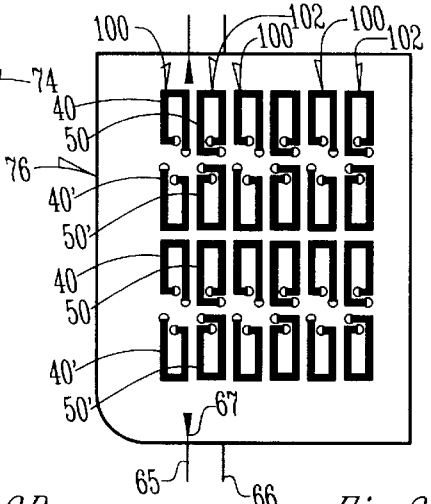
FIG. 3E is a plan view of a coil segment screen used for making of the inductor of FIG. 1.
Figure 3D:
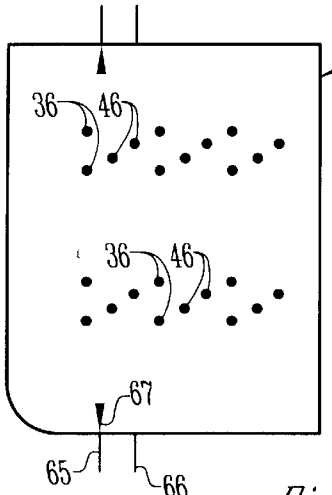
FIG. 3D is a plan view of a via fill screen used for making the inductor of FIG. 1.
Figure 3C:
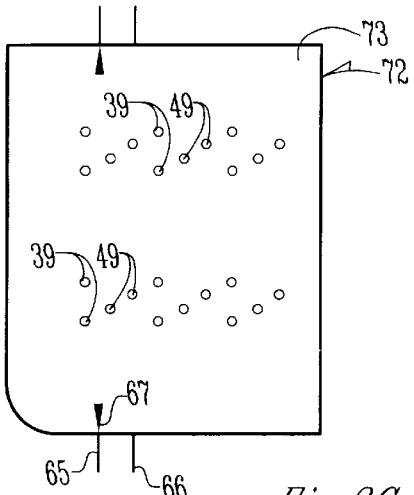
FIG. 3C is a plan view of a dielectric screen used for printing various dielectric layers in the inductor of FIG. 1.
Figure 3J:
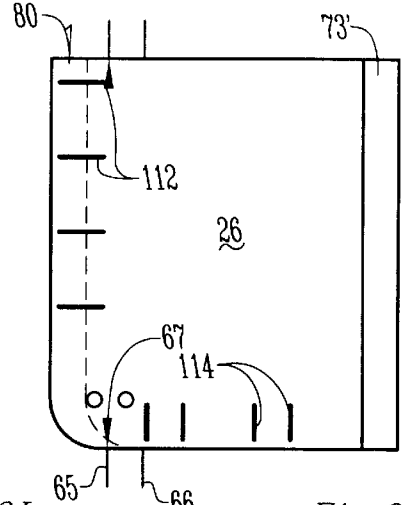
FIG. 3J is a plan view of a top cap screen used for making the inductor of FIG. 1.
Figure 3I:
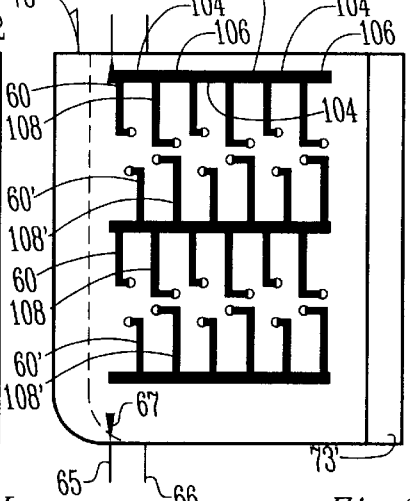
FIG. 3I is a plan view of a top termination screen used for making the inductor of FIG. 1.

The other printing screens used to print the inductor 10 are the bottom termination screen 70 (FIG. 3B), a dielectric screen 72 (FIG. 3C), a via fill screen 74 (FIG. 3D), a coil segment screen 76 (FIG. 3E), a top termination screen 78 (FIG. 3I), and a top cap screen 80 (FIG. 3J).

Referring to FIG. 3B, a first column 88 and a second column 90 are shown, each of which contain a plurality of bottom termination conductors 92, 92' and 94, 94'. Columns 88, 90 repeat three times on the pattern shown in FIG. 3B, but the number of repetitions may vary as desired. The first bottom termination column 88 includes a plurality of bottom termination coils 92 and 92' which are identical in shape, but which are arranged in symmetrical mirrored pairs with respect to one another.

Second bottom termination column 90 includes second bottom termination coils 94 and 94', which are identical to one another and which are arranged in symmetrical pairs with respect to one another.

Referring to FIG. 3C, dielectric screen 72 prints a dielectric layer 73 having a plurality of via holes 39, 49 therein. When screen 72 is positioned over the printed bottom termination conductors of FIG. 3B, and is registered in the first index position with arrow 67 aligned with index mark 65, the via openings 39, 49 each register with one of the ends of the termination conductors 92, 92' or 94, 94'. When the screen 72 is in its first index position (FIG. 3C), the left column of via openings 39 registers with the ends of the first termination conductors 92, 92' in row 88 of FIG. 3B.

The via fill screen 74 shown in FIG. 3D includes a plurality of via conductors 36, 46, which when printed over dielectric layer 73 in the first index position, register with and fill the via openings 39, 49 respectively of dielectric layers 73.

The coil segment screen 76 of FIG. 3E includes a first coil segment column 100 and a second coil segment column 102 which alternate with one another. Column 100 includes a plurality of coil segment patterns which are of the same configuration as first coil segment 40 in FIG. 2, and second coil segment column 102 includes a plurality of coil conductors which are of the configuration of second coil segment 50 in FIG. 2. When coil segment screen 76 is placed in its first index position overlying the dielectric layer 73, it will cause each of the first ends 42 of coil segments 40 to be registered with one of the via openings 39 and via fills 36. In that first index position, first coil ends 52 of the coil segments 50 in second coil segment column 102 are also registered with one of the via openings 49 and the via fills 46.

FIG. 3F shows the dielectric screen 72 indexed to its second position for printing over the coil segment rows 100, 102. In this second indexed position the left column of via openings 39 is registered over the second coil segment ends 54 in row 102, and the second column of via openings 49 is registered over the first ends 44 of the coil segments 40 in the second column 100 from the left as shown in FIG. 3E.

Figure 3H:
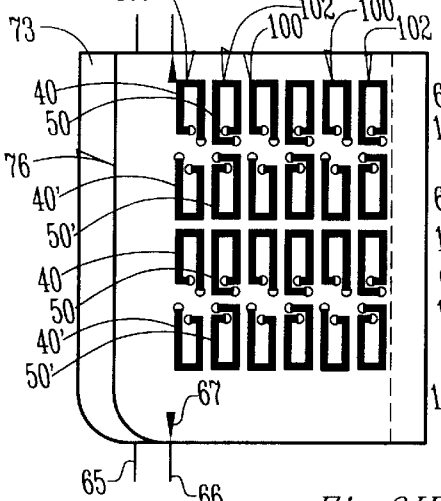
FIG. 3H is a plan view showing the coil segment screen of FIG. 3A in its second index position.
Figure 3G:
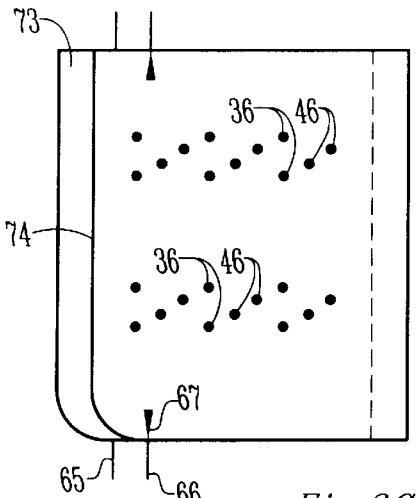
FIG. 3G is a plan view showing the second indexed position of the via fill screen of FIG. 3D.

FIG. 3G shows the via fill screen 74 indexed to its second position with the via fills 36, 46 registered over the via openings 39, 49 of the dielectric layer 73' which is printed in FIG. 3F.

Referring to FIG. 3H, the coil segment screen 76 is indexed to its second indexed position with first coil segment column 100 registered above the first coil segment column 102 of FIG. 3E. In this position the coil segments 40 in FIG. 3H are registered above coil segments 50 in row 102 of FIG. 3E.

After screens 72, 74, 76 have been printed in their second indexed position, they are shuttled back to their first indexed position and the printing process is repeated as many times as desired until the desired turns of coils are achieved.

Then the top termination screen 78 is used to print the top termination layers 24. The conductors in printing screen 78 are arranged in a first column 104 and a second column 106. Column 104 includes the top termination conductors 60 which are adapted to register over the second coil segments 50. Column 106 shows a second form of termination conductor 108 which is adapted to register over first coil segment 40. It should be noted that the top termination screen 78 is shown indexed to its first position so that the left most column 106 register with the left most column 100 in FIG. 3E and the second from the left column 104 registers with the left most column 102 of the coil segment patterns.

After printing the top terminations with the top termination screen 78, the top cap screen 80 is used to print a dielectric layer 26 over the entire assembly. A plurality of row cut marks 112 and a plurality of column cut marks 114 are printed on top cap screen 80 by a separate screen (not shown) and are used to align a cutting tool for cutting the various individual inductors 10 from the assembly.

The printing screens of FIGS. 3A–3J are used in a two step process for printing the inductor 10. That is printing screens 72, 74, 76 need only be indexed two times before being shuttled back to their original first index position to repeat the process as many times as desired to form the desired number of coil turns.

However, using different configurations for coil segments can permit the use of any desired number n of steps.

Furthermore, the via openings 39, 49 can be made much larger, and by doing so can permit the elimination of the use of the via fills 36, 46. This eliminates the need for the via fill printing screen 74. If the via openings 39, 49 are sufficiently large, the various coil segments can contact one another through the connecting openings or via openings 39, 49 without the need for via fills 36, 46.

Referring to FIGS. 4A–4M and 5A–5B, a system of printing screens is shown for producing an inductor with a three step process.

Figure 4A:
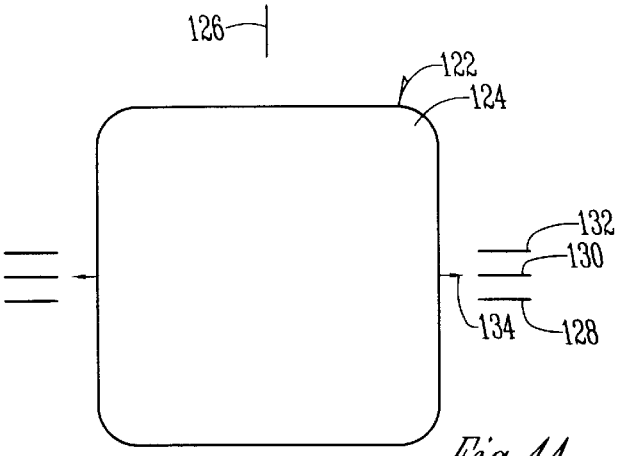
FIG. 4A is a plan view of a bottom cap screen used for making a modified form of the inductor.

FIG. 4A shows a bottom cap screen 122 for printing a dielectric cap 124, preferably formed of ferrite. The alignment marks 126 provide for alignment of the pattern with respect to a substrate, and the first, second and third index marks 128, 130, 132 show the three index positions used by the various printing screens. An index arrow 134 indicates that the bottom cap screen is printed initially in the second index position with arrow 134 aligned with index mark 130.

Figure 4B:
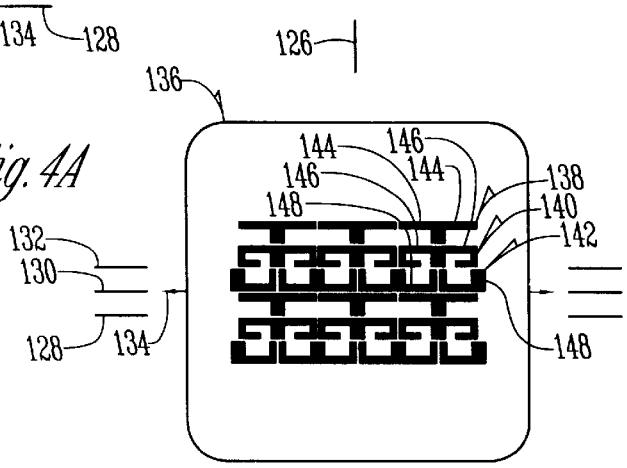
FIG. 4B is a bottom termination screen shown in its second index position with respect to the bottom cap screen of FIG. 4A.

FIG. 4B shows a bottom termination screen 136 having first, second, and third bottom termination rows 138, 140, 142. These rows 138, 140, 142 each include first bottom terminator connectors 144, second bottom termination connectors 146 and third bottom termination connectors 148. The termination connectors 144, 146 and 148 are each arranged in pairs which are mirror images of one another. The bottom termination screen 136 is shown in its second or middle index position wherein arrow 134 is registered with index mark 130.

Figure 4C:
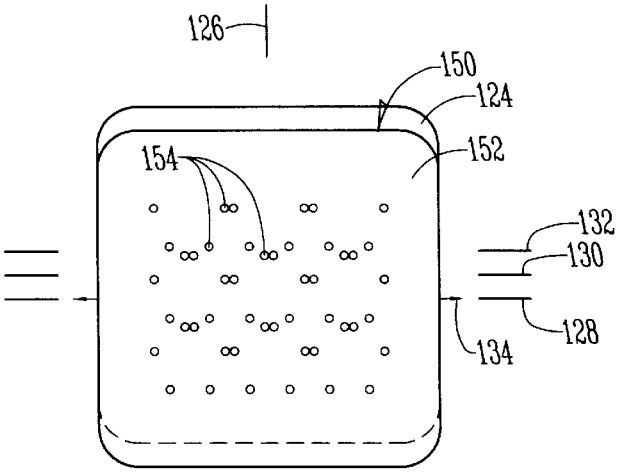
FIG. 4C is a plan view of a dielectric screen shown in its third index position with respect to the bottom cap screen 122.

FIG. 4C shows a dielectric screen 150 for printing a dielectric layer 152 having via holes 154 therein. The dielectric screen 150 is shown in its third index position wherein arrow 134 is registered with index mark 128.

Figure 4D:
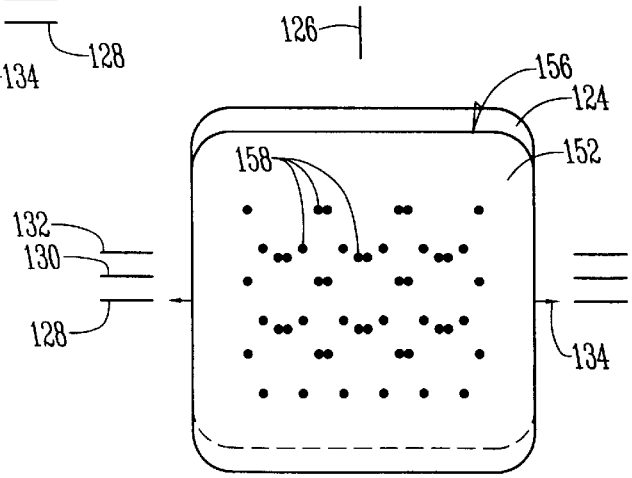
FIG. 4D is a plan view of a via fill screen shown in its third index position with respect to bottom cap screen 122.

Next, via fill screen 156 is shown in FIG. 4D to be indexed to its third index position for printing the via fills 158 in registered alignment over the via openings 154 in the dielectric layer 152.

Figure 4E:
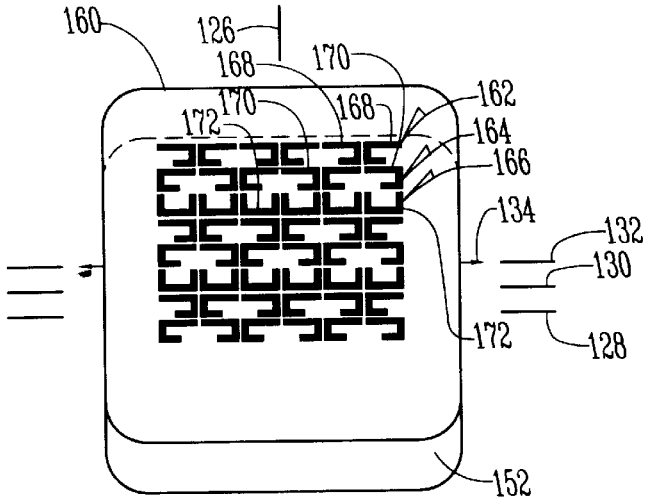
FIG. 4E is a plan view of a coil conductor screen shown in its first index position.

In FIG. 4E, a coil segment screen 160 is shown indexed to its first position with arrow 134 aligned with index mark 132. Coil segment screen includes first, second and third coil segment rows 162, 164, 166 each containing a first coil segment 168, a second coil segment 170 and a third coil segment 172.

Figure 4F:
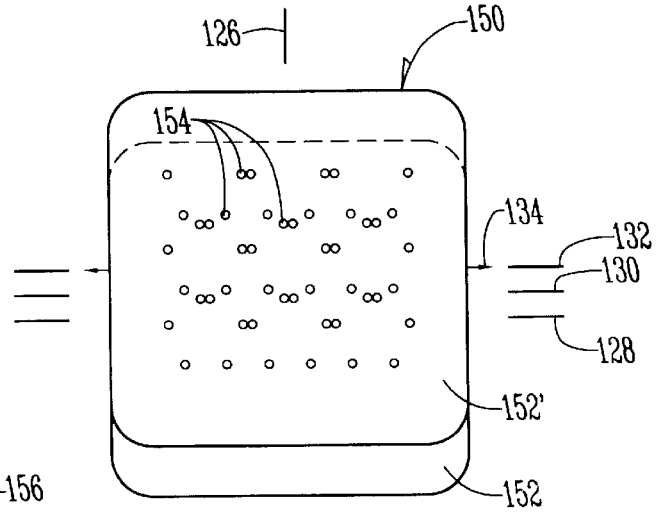
FIGS. 4F and 4G show the dielectric screen and the via fill screen respectively indexed to their first index positions.
Figure 4G:
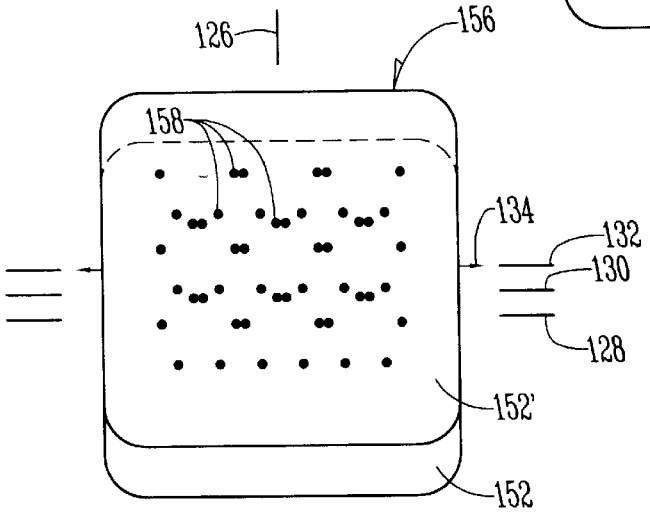

FIGS. 4F and 4G show the use of the dielectric printing screen 150 and the via fill screen 156, indexed to their first positions for printing a second dielectric layer 152' filled with fill conductors 158 over the coil conductors printed by soil segment screen 160 in FIG. 4E.

Figure 4H:
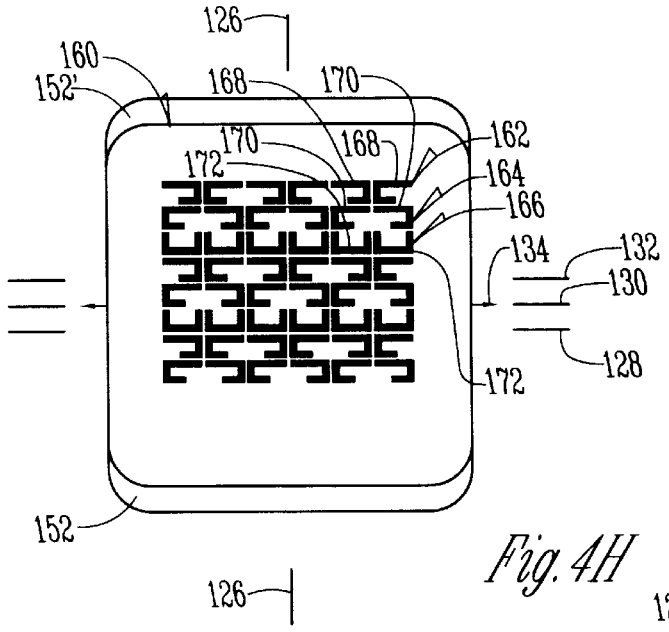
FIGS. 4H, 4I and 4J show the conductor coil screen, the dielectric printing screen, and the via fill screen, indexed to their second indexed positions.
Figure 4I:
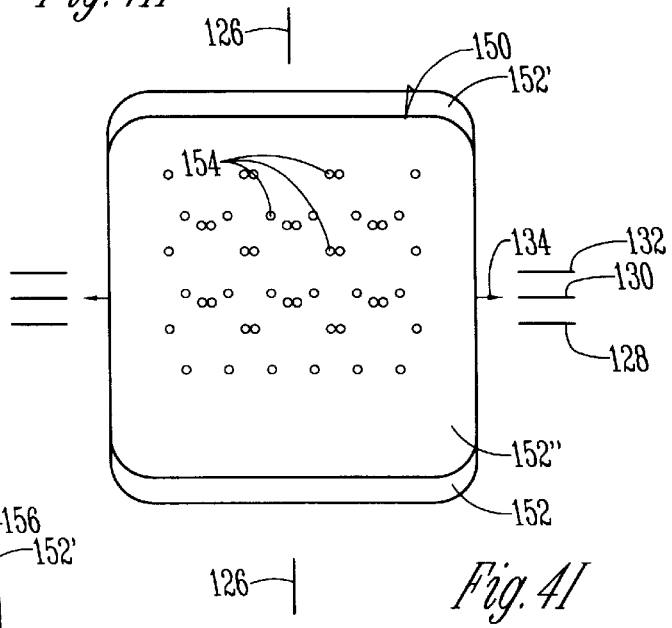
Figure 4J:
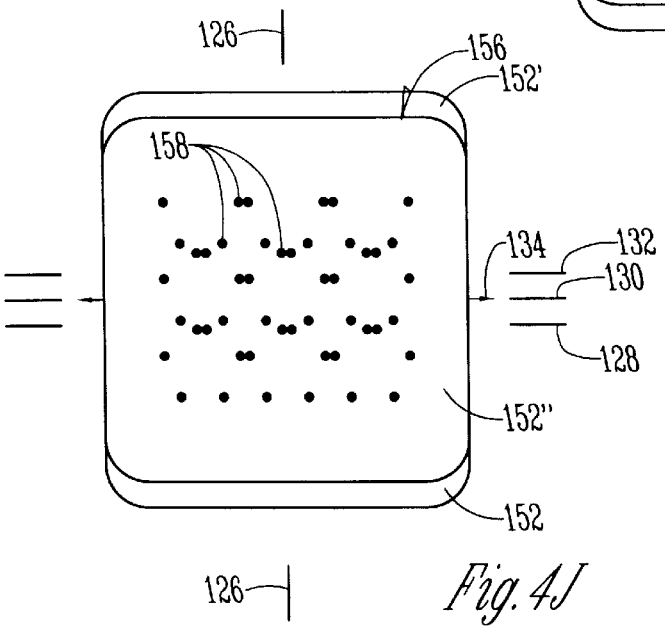

FIGS. 4H, 4I, and 4J show the printing of another coil segment pattern by the use of coil segment screen 160, dielectric screen 150, and via fill screen 156 indexed to their second positions. The dielectric layer from this printing is designated 152".

Figure 4K:
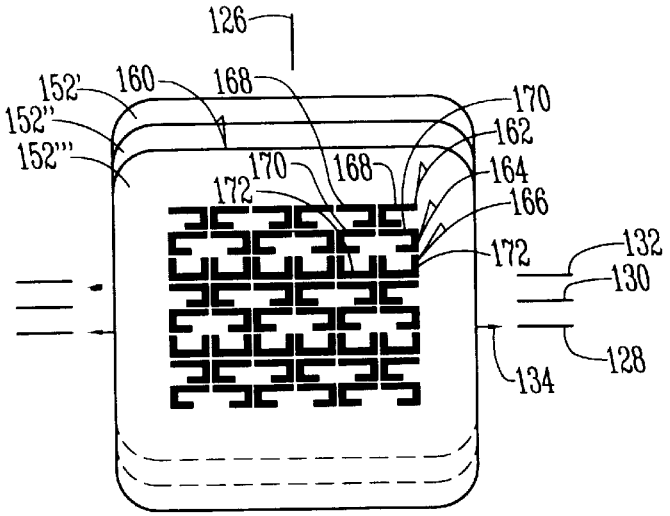
FIGS. 4K, 4L and 4M show the conductor coil screen, the dielectric screen, and the via fill screen respectively indexed to their third indexed positions.
Figure 4L:
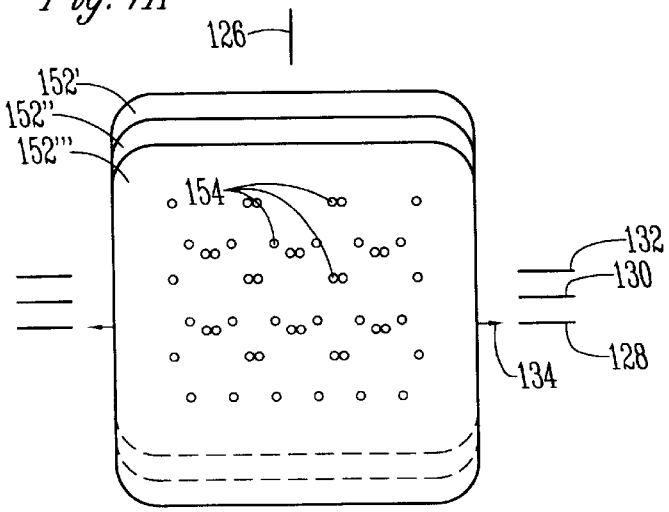
Figure 4M:
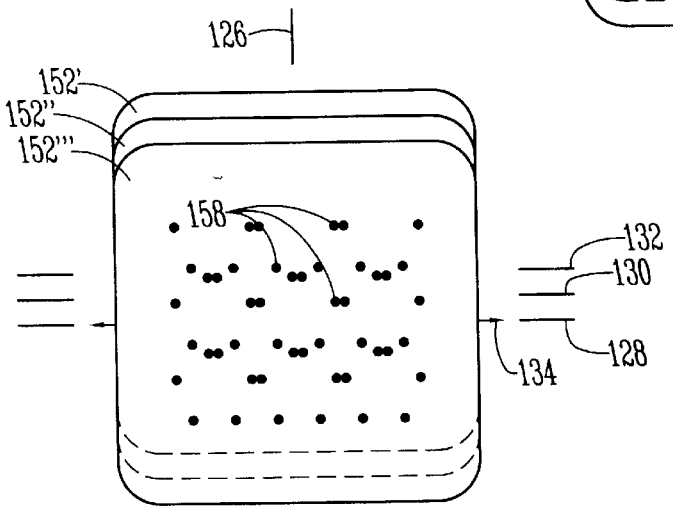

FIGS. 4K, 4L, and 4M show the use of screens 150, 156, and 160 for printing a third coil segment pattern with the various printing screens indexed to their third position. The dielectric layer from this printing is designated 152".

After the third printing shown by FIGS. 4K, 4L, and 4M, the screens are indexed back to their first position shown in FIGS. 4E, 4F, and 4G, and the process is repeated as many times as desired until the desired number of coil turns are achieved.

Figure 5A:
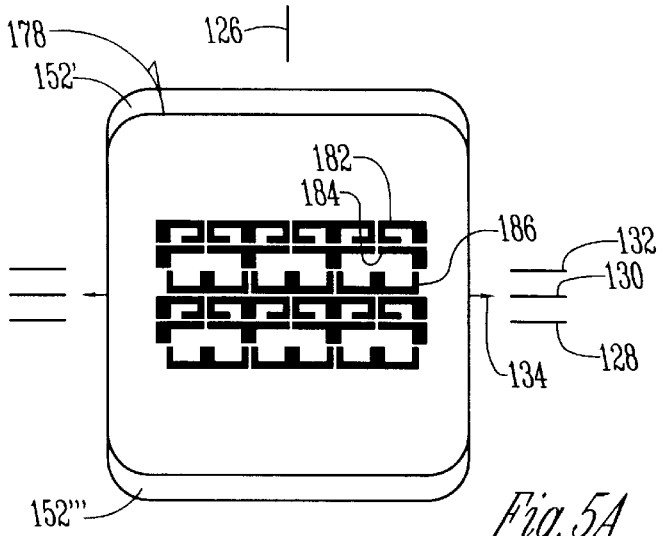
FIG. 5A shows a top termination print screen for use with the screens of FIGS. 4A–4M.

FIG. 5A shows a top termination screen 178 having three top termination configurations 182, 184, 186 which are adapted to register above the upper most printed coil segment pattern.

Figure 5B:
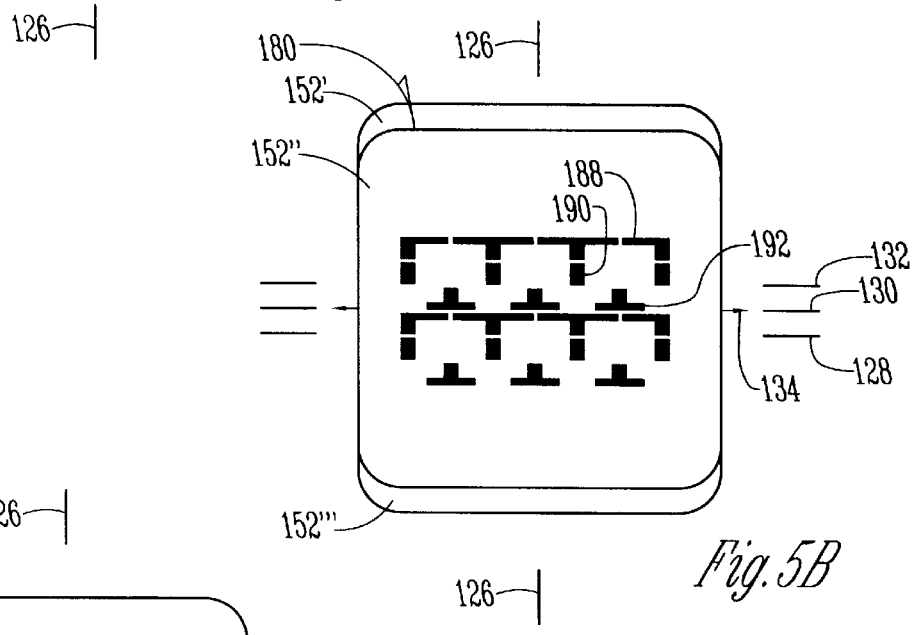
FIG. 5B shows a alternative termination print screen for use with the screens of FIGS. 4A through 4M.

The three step conductor is then completed by printing a top cap (not shown) over the top termination of FIG. 5A. FIG. 5B shows an alternative top termination screen 180 which may be used in the place of the top termination screen 178 of FIG. 5A.

Figure 6:
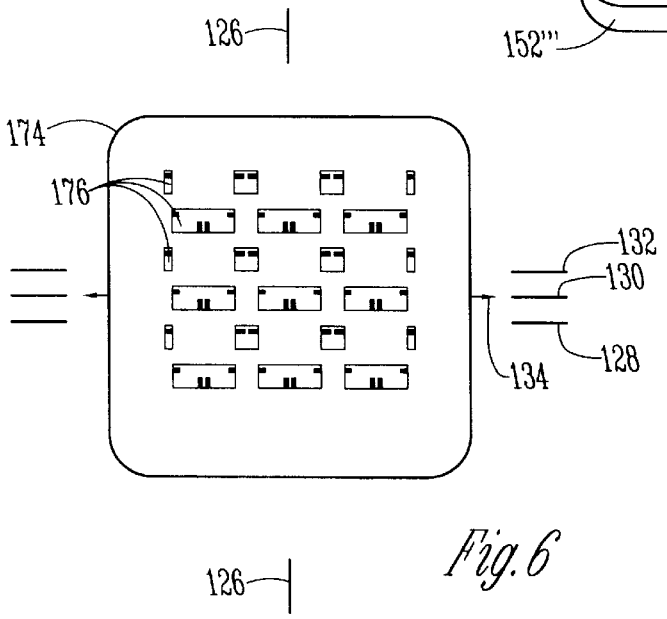
FIG. 6 shows an alternative form of a dielectric screen which may be used in the place of the dielectric screen of FIG. 4C.

Referring to FIGS. 6, a modified form of dielectric screen 174 is shown for use in the place of dielectric screen 150 of FIG. 4C. Instead of the small via openings shown in dielectric screen 150, the dielectric screen 174 includes much larger connecting openings 176 which expose portions of the coil conductors located therebelow. The advantage of using the dielectric screen 174 is that there is no need to print via fills in the openings 176. Instead, the coil segments above and below the dielectric layer printed by screen 174 are able to contact one another and form electrical continuity through the openings 176.

The art work of the present invention is designed so that either the thick film screen on the printer, or the substrate on which the pattern is being printed may be shuttled to a new location instead of changing screens on the printer for each layer. Previous methods required separate printer patterns for each layer.

Another feature of the present invention is that less equipment is needed to mass produce an inductor because fewer printers are required. The first option shown in FIGS. 1–3 requires only three patterns (dielectric screen 72, via fill screen 74, and coil segment screen 76 (in repeating sequence) to produce any number of turns in the coil. Thus only three separate printers are required to produce as many coil turns as desired.

If a dielectric pattern having large connecting openings such as shown in FIG. 6 is used, there is no need to use a via fill screen such as via fill screen 74 or via fill screen 156. This reduces each repeating sequence to only two patterns, thereby reducing the number of printers by one additional one.

Automation of the entire process is much simpler due to the reduced printer count. Also, because the parts must be dried after each print, automation of the movement through the dryer becomes easier. It is possible to reduce the number of drying ovens to two with either of the above two methods. With prior methods, automation would require not only more printers but more dryers also.

In the drawings and specification there has been set forth a preferred embodiment of the invention, and although specific terms are employed, these are used in a generic and descriptive sense only and not for purposes of limitation changes in the form and the proportion of parts as well as in the substitution of equivalents are contemplated as circumstances may suggest or render expedient without departing from the spirit or scope of the invention as further defined in the following claims.

What is claimed is:

1. A method for forming a laminated electrical component comprising:

printing a first conductive layer in a first index position on a substrate with a coil printing screen, said first conductive layer comprising n coil segments arranged in side to side relationship, each of said n coil segments being different from one another and comprising a different segment of a helical coil;

printing a first dielectric layer with a dielectric screen on said first conductive layer, said first dielectric layer having a plurality of connecting openings therein, each of which is registered above and exposes a portion of one of said n coil segments therebelow;

indexing said coil printing screen and said dielectric printing screen from said first index position to a total of n index positions one at a time;

printing an additional conductive layer and an additional dielectric layer with said coil printing screen and said dielectric printing screen at each of said n indexed positions until a total of n conductive layers and n dielectric layers have been printed;

choosing each of said n indexed positions so that a different one of said n coil segments in each of said additional conductive layers is registered above a selected one of said n coil segments in said first conductive layer;

joining adjacent pairs of said coil segments above and below each of said dielectric layers by permitting said adjacent coil segments to electrically contact one another through said connecting openings in each of said dielectric layers to create a first helical sub coil;

shuttling said coil printing screen and said dielectric printing screen back to said first index position;

repeating said steps for forming said first helical sub coil one or more times so as to form one or more additional helical sub coils which are in electrical connection with and above said first helical sub coil.

2. A method according to claim 1 wherein n=2.

3. A method according to claim 2 wherein n>2.

4. A method according to claim 1 and further comprising printing a bottom termination pattern on said substrate before said printing of said first conductive layer, said bottom termination pattern comprising n terminations, each of which registers with and is electrically connected to one of said coil segments after said printing of said first conductive layer of said coil segment pattern.

5. A method according to claim 4 and further comprising printing said dielectric pattern over said termination pattern before said printing of said first conductive layer of said coil segment pattern, said dielectric pattern being positioned to permit electrical connection of each of said terminations to one of said n coil segments through one of said n connecting openings when said first conductive layer is printed.

6. A method according to claim 1 and further comprising printing via fills of conductive material in each of said connecting openings after printing each of said n dielectric layers and before printing the next of said n conductive layers over each of said n dielectric layers.

7. A method for forming a laminated electrical component comprising:

printing a first conductive layer in a first index position on a substrate with a coil printing screen, said first conductive layer comprising n coil segments arranged in side to side relationship, each of said n coil segments being different from one another and comprising a different segment of a helical coil;

printing a first dielectric layer with a dielectric screen on said first conductive layer, said first dielectric layer having a plurality of connecting openings therein, each of which is registered above and exposes a portion of one of said n coil segments therebelow;

indexing said coil printing screen and said dielectric printing screen from said first index position to a total of n index positions one at a time;

printing an additional conductive layer and an additional dielectric layer with said coil printing screen and said dielectric printing screen at each of said n indexed positions until a total of n conductive layers and n dielectric layers have been printed;

choosing each of said n indexed positions so that a different one of said n coil segments in each of said additional conductive layers is registered above a selected one of said n coil segments in said first conductive layer;

joining adjacent pairs of said n coil segments above and below each of said dielectric layers by filling said connecting openings with a conductive material contacting both of said adjacent coil segments above and below each of said connecting openings to form a helical subcoil;

shuttling said coil printing screen and said dielectric printing screen back to said first index position;

repeating said steps for forming said first helical sub coil one or more times so as to form one or more additional helical sub coils which are in electrical connection with and above said first helical sub coil.

* * * * *